United States Patent [19]

Gassett et al.

[11] 3,964,423

[45] June 22, 1976

[54] OFFSHORE TERMINAL

[75] Inventors: Paul L. Gassett; Wilfred R. McLeod, both of Houston, Tex.

[73] Assignee: Gulf Research & Development Company, Pittsburgh, Pa.

[22] Filed: Feb. 24, 1975

[21] Appl. No.: 552,465

Related U.S. Application Data

[60] Continuation of Ser. No. 426,355, Dec. 19, 1973, abandoned, which is a continuation of Ser. No. 297,564, Oct. 13, 1972, abandoned, which is a division of Ser. No. 126,661, March 22, 1971, Pat. No. 3,765,463.

[52] U.S. Cl. ..... 114/230; 9/8 P

[51] Int. Cl.[2] ..... B63B 21/56

[58] Field of Search ..... 9/8 P; 114/230, 235 R, 114/235 A

[56] References Cited

UNITED STATES PATENTS

| | | | |
|---|---|---|---|
| 3,366,088 | 1/1968 | Gibson | 114/230 |
| 3,494,318 | 2/1970 | Katsumura | 114/235 |
| 3,522,787 | 8/1970 | Tam | 114/230 |
| 3,707,934 | 1/1973 | Frankel | 114/230 |

*Primary Examiner*—Trygve M. Blix
*Assistant Examiner*—Gregory W. O'Connor

[57] ABSTRACT

In an offshore terminal for loading tankers, a bottom-supported column is surrounded by a floating collar. Standpipes in the column for connection with transfer lines to shore are connected by flexible lines to the collar. A floating station flexibly connected to the collar extends radially from the collar to support rigid pipes. An elongated powered boom having a power unit at each end supports rigid pipes which are connected by flexible hoses to the manifold of a tanker at one end and at the other end to the pipes supported by the floating station. The wide spacing apart of the power units on the powered boom facilitates the powered boom holding the tanker from swinging and picking up momentum that might damage the terminal.

7 Claims, 5 Drawing Figures

OFFSHORE TERMINAL

This is a continuation of application Ser. No. 426,355 filed Dec. 19, 1973.

Ser. No. 426,355, now abandoned, was a continuation of our Application Ser. No. 297,564, filed Oct. 13, 1972, and entitled Offshore Terminal, also abandoned, which was a division of our Application Ser. No. 126,661, filed Mar. 22, 1971, entitled Offshore Terminal, now U.S. Pat. No. 3,765,463.

This invention relates to an offshore terminal particularly suited for the mooring of giant tankers while they are either loaded or unloaded.

The giant tankers that have been constructed recently in an effort to reduce the cost of transportation of crude oil create difficult problems of mooring while the tankers are either loaded or unloaded. Because of the draft of the giant tankers there are few harbors in which the water is deep enough for those tankers. The high cost of construction of conventional docks in water deep enough to float the giant tankers precludes the usual docking arrangement.

One method that has been adopted in recent years for mooring tankers in exposed water is the single-point mooring system. In that system, the tanker is connected by a line from its bow to a mooring platform or an anchored buoy. The tanker is allowed to rotate around the buoy in response to changes of wind and tide. The tremendous size of the giant tankers recently constructed results in the tankers picking up such momentum as a result of movement by winds and tide that the single-point mooring stations would be endangered. The cost of construction of a single-point mooring system capable of withstanding the forces to which it would be exposed by the giant tankers is prohibitive.

Patents disclosing structures for single-point mooring systems are:

| | | | | |
|---|---|---|---|---|
| U. S. | 3,335,690 | Busking | Aug. | 15, 1967 |
| Patents | 3,354,479 | Koppenol et al | Nov. | 28, 1967 |
| Nos. | 3,366,088 | Gibson | Jan. | 30, 1968 |
| | 3,522,787 | Tam | Aug. | 4, 1970 |
| | 3,541,622 | Harlow | Nov. | 24, 1970 |
| | 3,595,195 | Van Eek | July | 27, 1971 |
| | 3,595,196 | Riffeser | July | 27, 1971 |

In the single-point mooring system, flexible hoses are connected from the manifold on board the tanker to standpipes in the mooring station. There are limitations on the size of flexible hoses that can be handled that make them unsuited for loading or unloading giant tankers some of which are equipped with pumps capable of unloading at rates as high as 100,000 barrels per hour. Moreover, damage to submarine flexible hoses and connections to the manifold on the tanker is frequently caused by movement of the tanker during the loading operation. The midship location of the manifold on most tankers increases the likelihood of damage to flexible hoses. If floats are provided to maintain the hose on the surface of the water, the hose is then subject to stress from wave and storm action.

This invention is used with an offshore terminal for loading and unloading tankers which includes a bottom-supported column encircled by a vertically movable floating collar having outlets for connection to floating stations which extend outwardly from the collar. The floating stations support large diameter pipes which are connected through passages in the floating collar to deliver oil into standpipes in the column. The standpipes are connected to lines from storage. In this invention an elongated powered loading boom supports pipe between power units located at each end of the boom for the delivery of oil from or to the tanker. Flexible hose means are provided for connecting the pipes on the powered loading boom to the ship's manifold and to the pipes on the floating stations. The power units on the ends of the powered boom are capable of maneuvering the tanker to the desired location for the loading or unloading operation and preventing excessive movement of the tanker during the operation.

Figures 1, 5:
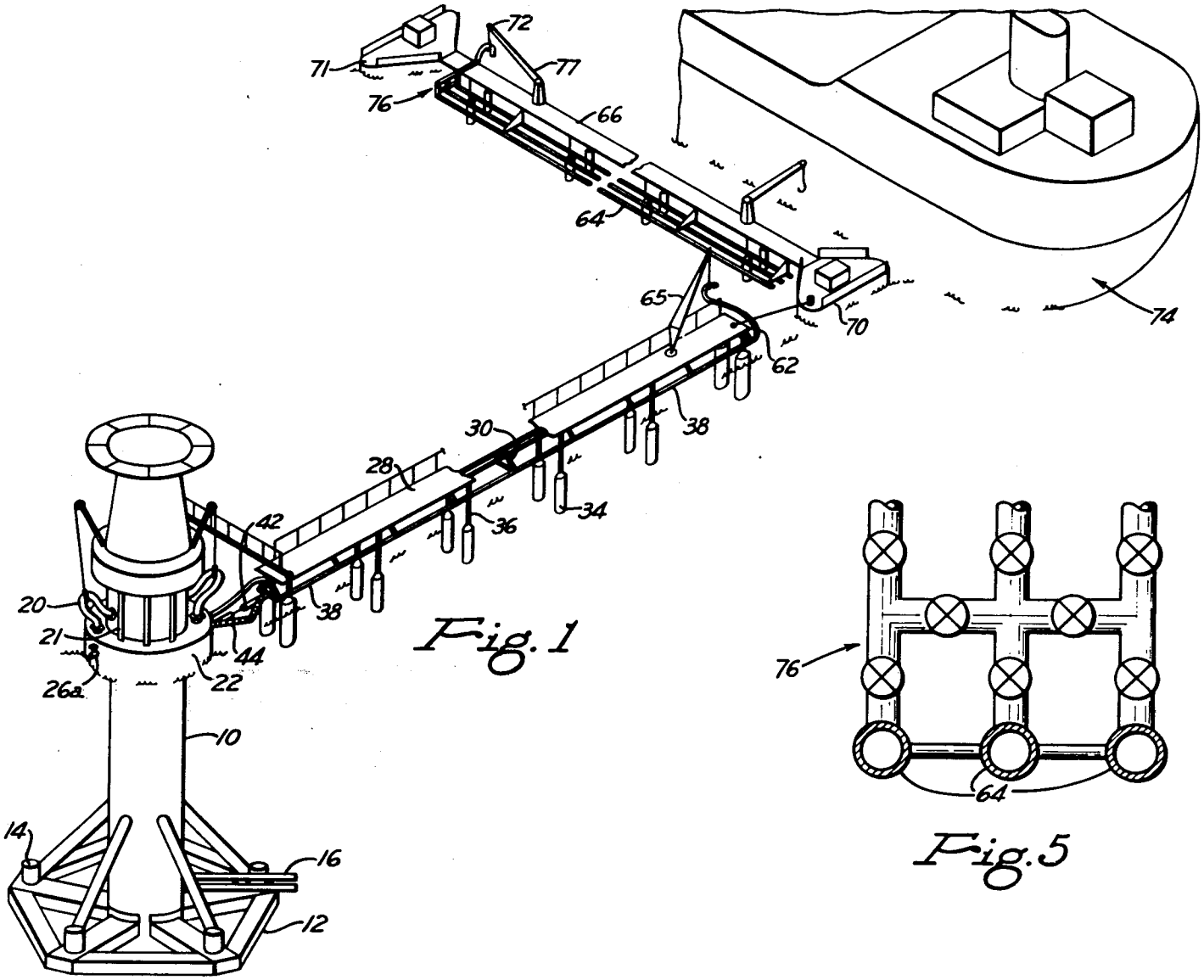
FIG. 1 is a diagrammatic perspective view showing the offshore terminal of this invention with the powered loading boom connected to a tanker.
FIG. 5 is an elevational view, partially in vertical section, of the manifold on the powered loading boom.

Referring to FIG. 1 of the drawings, a column 10 is shown having a base 12 secured to the ocean floor by suitable piling driven through sleeves 14 forming a part of the base. Although a bottom-supported column anchored to the ocean floor is shown, this invention is not limited to such structure. Column 10 could be a leg of an offshore platform or could be a semisubmersible unit that is floated to location and then sunk by admission of water into compartments at the base of the column. Delivery lines 16 extend from the lower end of the column 10 along the ocean floor to onshore storage or pipelines, not shown. The delivery lines 16 are connected at the bottom of column 10 with standpipes 18 extending upwardly through the column.

Figure 2:
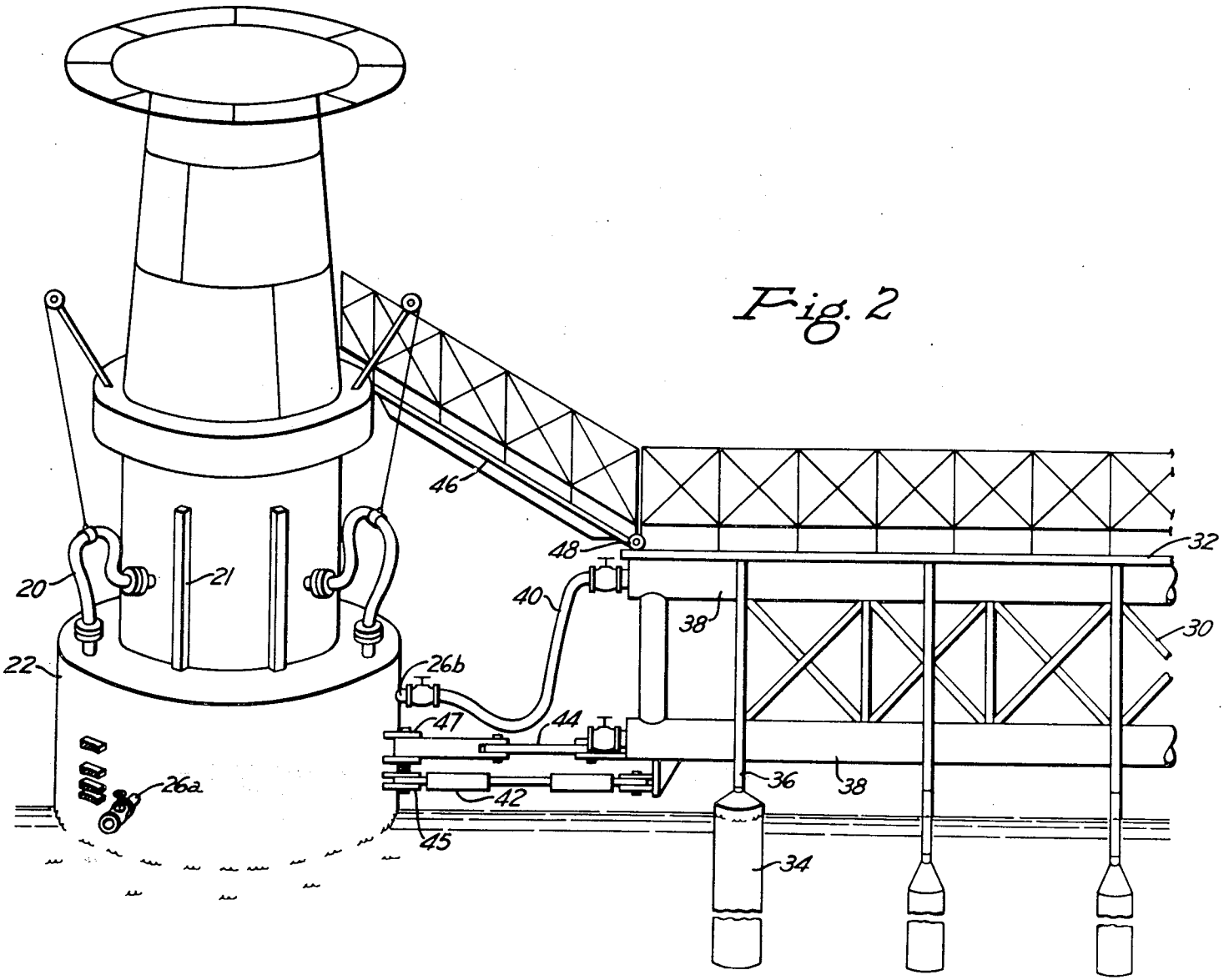
FIG. 2 is a perspective view of the floating collar connected to one of the floating stations.
Figure 3:
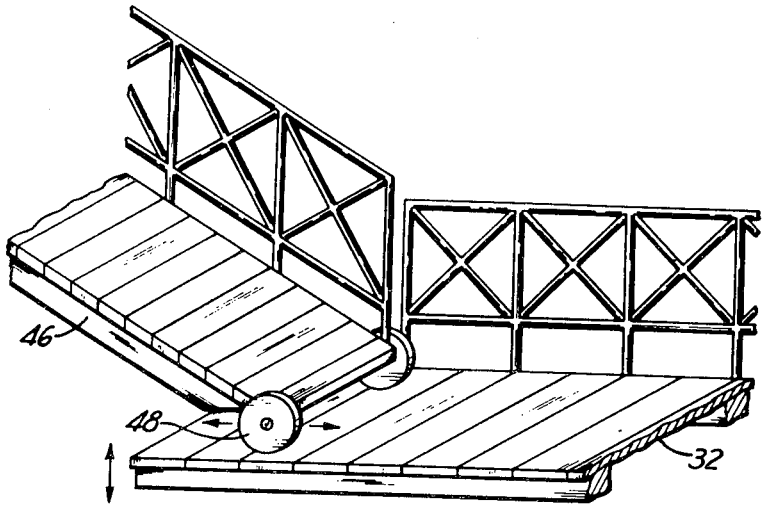
FIG. 3 is a fragmentary sectional view showing a telescoping joint in the floating station.
Figure 4:
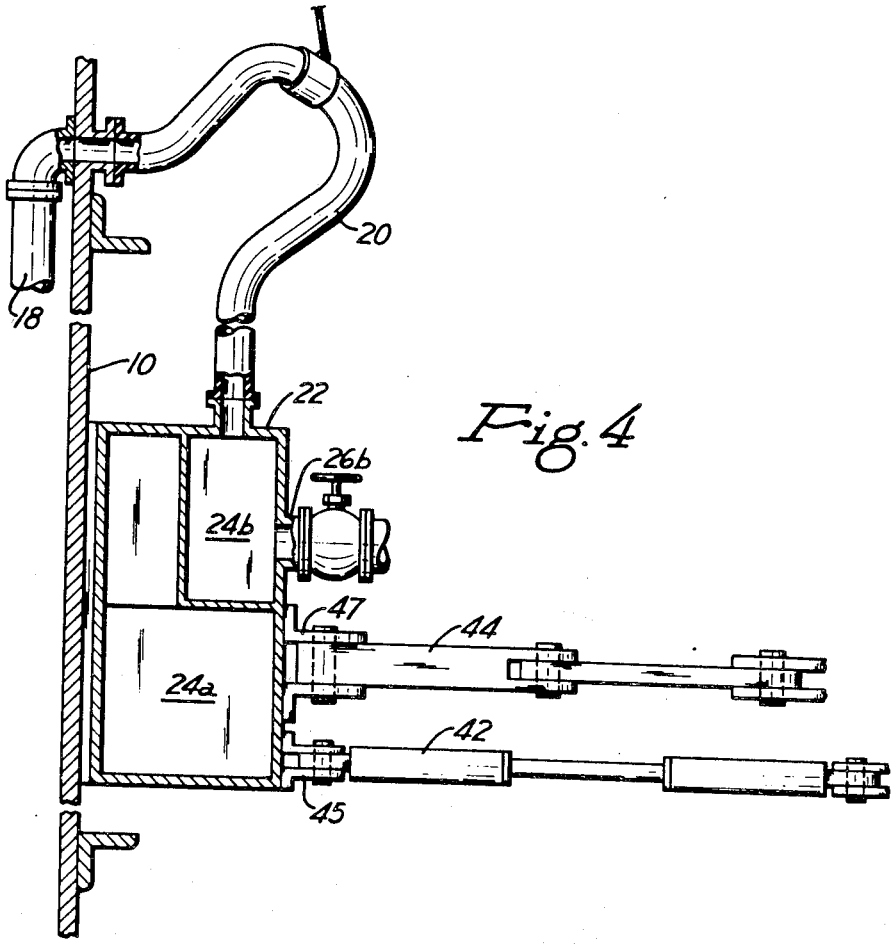
FIG. 4 is a diagrammatic vertical sectional view of the floating collar.

The upper ends of standpipes 18 are connected through flexible lines 20 to a floating collar 22 encircling column 10. Floating collar 22 is slidably mounted on the outer surface of column 10 and guided by splines 21 that engage grooves in collar 22 to allow the collar to move vertically along the outer surface of the column in response to tide and waves. As is shown in FIGS. 2 and 4, nozzles **23*a* and 23*b* from separate compartments 24a and 24*b* in floating collar 22 can be connected to lines 20 to allow simultaneous handling of two or more liquids and flow from one chamber into a standpipe 18 independently of the other chambers. Nozzles 26*a* and 26*b* open compartments 24*a* and 24*b*, respectively, through the outer wall of the floating collar 22** for connection to lines for loading or unloading a tanker as is hereinafter described.

Connected to the floating collar and extending outwardly therefrom are a plurality of floating stations 28, only one of which is shown in the drawings. Column 10 shown in FIG. 1 and FIG. 2 is equipped to receive three such stations. Nozzles **26*a* and 26*b* on floating collar 22 for receiving connections from two of the floating stations are visible in FIGS. 1 and 2. The floating stations comprise framework 30, best illustrated in FIG. 2, supporting a walkway 32 along its upper surface. Floats 34 have thin adjustable legs 36 extending upwardly from their upper end secured to framework 30 to support floating station 28 above the surface of the water. It is preferred that the upper end of most of the floats 34 be below the surface of water a distance adequate to minimize the effect of waves on the station 28.** In the apparatus shown in the drawings, the floats 34*a* nearest the ends of the floating chamber extend upwardly above the water to insure the necessary buoyancy.

Running longitudinally of the floating station 28 are a plurality of pipes 38 for carrying liquid to the tanker being loaded. The ends of the pipes nearest the floating collar are connected to flexible hoses 40 which in turn are connected to the nozzles 26*a* and 26*b*. In the embodiment illustrated in FIG. 2, three pipes 38 are supported in a triangular arrangement by the floating station. Pipes 38 will ordinarily have a diameter of 16 to 30 inches at terminals designed for the loading of giant tankers.

Hydraulic shock absorbers 42 and flexible joints 44 connect one end of the floating station 28 to the floating collar in a manner such as the pin and clevis 45 and 47 that permits some pivoting of the station 28 relative to the floating collar 22 to provide some flexibility in positioning the outer end of the floating station 28. A ramp 46 from the near end of station 28 to column 10 has wheels 48 along its outer end to accommodate movement of the station. Wheels 48 roll on walkway 32.

The outer end of station 28 is provided with flexible hoses 62 adapted to be connected to the near end of pipes 64 mounted on a powered loading boom 66. Suitable lifting means such as cranes 65 are mounted on the floating station 28 to support the flexible hoses 62 above the water surface to avoid the stresses and resultant wear caused by waves. Powered loading boom 66 comprises an elongated framework, which can be similar to the framework of floating station 28, supported by floats located at intervals between the ends of the powered loading boom 66. The ends of powered loading boom 66 are supported and secured to power units 70 and 71 which are essentially motor driven vessels generally similar to tugs. For example, each power unit may be a vessel having a 1000 h.p. diesel motor mounted therein to drive a propeller and provided with a rudder to permit substantially independent maneuvering of each end of the powered loading boom 66 with the exception that the distance between the power units remains substantially constant. Hoses 72 are provided at the end of the powered loading boom 66 for connection to the manifold usually located at a midship position on a tanker indicated generally by reference numeral 74. A single hose 72 is shown to avoid crowding the drawings, but it is contemplated that loading or unloading may proceed simultaneously through all of pipes 64. Lift 77 supports hoses 72 above the water. Powered loading boom 66 is equipped with a manifold 76, diagrammatically shown in FIG. 5, to provide flexibility in piping from the tanker 74 to station 28.

An important function of the powered loading boom is to prevent swinging of the tanker around its anchored end. Such swinging would allow the tanker to acquire sufficient momentum to damage the terminal. Stability of the tanker and lines from the tanker is increased by the distance between power units 70 and 71. The length of the powered loading boom will be determined by the size of tanker the boom is designed to load. It is desirable to locate one of the power units adjacent the manifold on the tanker. The other power unit should be near the bow or stern of the tanker to exert a large turning moment opposing movement of the tanker. The distance between power units should be at least one-third the length of the tanker to be loaded. A distance of 100 to 400 feet is preferred. Pipes 64 of generally the same size as pipes 38 extend the full length of powered loading boom 66. Pipes 64 can be supported in any convenient arrangement such as the triangular arrangement shown on the floating station 28 or in a single plane, as shown.

When one of the giant tankers is to be loaded at the offshore terminal, the tanker will drop anchor to pick up an anchor line from a preset anchor at a substantial distance, e.g. ¼ mile, from column 10 and thereby greatly reduce chances of collision with column 10 or floating station 28. The powered loading boom 66 is then connected to the tanker and used to pull the tanker to a position near the outer end of floating station 28. When the tanker is at the desired location, the flexible hoses 62 are connected to the manifold 64 on the powered boom, flexible hoses 72 are connected to the manifold on the tanker, and loading of the tanker 74 through delivery lines 16, standpipes 18 and the pipes of the floating station and powered loading boom is begun. The power units at the end of the boom 66 hold the tanker in the desired position against the forces of tide and waves during the loading operations.

Although the terminal operation has been described for loading a tanker, it, of course, is equally useful for unloading a tanker. The term loading has been used for convenience to designate either loading or unloading. For example, in unloading, oil is pumped from the manifold on the tanker through hoses 72 into pipes 64 on powered loading boom 66 and flows through the flexible hoses 62 into the pipes 38 on station 28 and then into the floating collar 22. Oil delivered into each of the compartments of the floating collar 22 is discharged through the appropriate outlet from the compartment into flexible hoses 20 and into standpipes 18 within the column 10. The oil flows from the standpipes through lines 16 to storage.

The floating powered loading boom permits loading into a tanker through the usual midship manifold. Although the tanker is anchored a substantial distance from the column 10, the column 10 is in no way endangered as in single-point mooring by momentum the tanker may pick up because the powered boom 66 is hooked onto the tanker at a substantial distance from the bow and limits movement of the stern of the tanker. The danger of damage to flexible hoses lying on the bottom or floating on the surface is avoided by use of the rigid pipes supported by the framework of powered loading boom 66 and station 28. Damage to flexible lines by ship movement or by storms is avoided by this invention by allowing use of short hoses supported above the water.

We claim:

1. In an offshore terminal for delivering oil from one to the other of a tanker and an elongated floating station adapted to rotate about a terminal unit connected by delivery lines to onshore storage, said floating station having an outer end remote from the terminal unit and an inner end connected to the terminal unit for delivery of oil thereto, an improved loading boom comprising an elongated framework spaced from the terminal unit and movable independently thereof, a power unit at each end of the framework for movement of each end of the loading boom independently of the other end, a plurality of pipes supported by the framework and extending substantially the full length of said framework, float means extending downwardly into the water at intervals located between the power units to support the framework above the water, first flexible conduit means at one end of the framework for connecting one end of the pipes to the tanker, and second flexible conduit means at the other end of the framework for connecting the other end of the pipes to the outer end of the floating station, said power units having power adequate to move the tanker to the desired position and to resist wind and wave forces to maintain the tanker at the desired location during loading operations.

2. An improved loading boom as set forth in claim 1 in which the power units are separated by a distance in the range of 100 – 400 feet.

3. An improved loading boom as set forth in claim 2 in which each of the power units has at least 1,000 horsepower.

4. A loading boom movable independently of an offshore terminal for moving a tanker through water into position at the offshore terminal and maintaining the tanker in position during loading comprising:

a. an elongated framework;

b. a plurality of pipes for transporting oil from one end of the loading boom to the other supported by the framework and extending longitudinally for substantially the full length of the framework;

c. a power unit at each end of the framework supporting the framework and pipe above the water level;

d. each of said power units being constructed and arranged for moving each end of the power boom independently of the other end;

e. the power units having power adequate to move the tanker to a desired position at the offshore terminal and maintain the tanker at said desired position during loading operations; and f. a plurality of float means positioned at intervals along the framework extending downwardly therefrom into the water to support the framework and pipes above the water.

5. A loading boom movable independently of an offshore terminal for moving a tanker through water into position at the offshore terminal and maintaining the tanker in position during loading comprising:

a. an elongated framework having a length in the range of 100 to 400 feet;

b. a plurality of pipes for transporting oil supported by the framework;

c. a power unit at each end of the framework supporting the framework and pipes above the water;

d. each of said power units comprising a motor, a propeller driven by the motor and rudder means adapted to move each end of the loading boom independently of the other end;

e. the power units having power adequate to move the tanker to a desired position at the offshore terminal and maintain the tanker at said desired position during loading operations; and f. a plurality of float means positioned at intervals along the framework extending downwardly therefrom into the water to support the framework and pipes above the water.

6. A loading boom as set forth in claim 3 including lift means on the boom adjacent the flexible conduits for supporting the conduits above the water.

7. A loading boom movable independently of an offshore terminal for moving a tanker through water into position at the offshore terminal and maintaining the tanker in position during loading comprising:

a. an elongated framework;

b. a plurality of pipes for transporting oil from one end of the loading boom substantially to the other extending longitudinally of, and supported by, the framework;

c. a power unit at each end of the framework supporting the framework and pipe above the water level;

d. each of said power units comprising a motor, a propeller driven by the motor and rudder means adapted to move each end of the loading boom independently of the other end;

e. the power units having power adequate to move the tanker to a desired position at the offshore terminal and maintain the tanker at said desired position during loading operations;

f. float means between the power units extending from the framework downwardly into the water and adapted to support the framework and pipes above the water;

g. flexible conduits connected to the ends of the pipes for placing the pipes in communication with the tanker and terminal; and h. lift means mounted on the loading boom adjacent the flexible conduits for supporting the flexible conduits above the water.

* * * * *